US009899202B2

(12) United States Patent
Chiappetta et al.

(10) Patent No.: US 9,899,202 B2
(45) Date of Patent: Feb. 20, 2018

(54) TIME OF FLIGHT TUBES AND METHODS OF USING THEM

(71) Applicant: PERKINELMER HEALTH SCIENCES, INC., Waltham, MA (US)

(72) Inventors: Anthony Chiappetta, Milford, CT (US); Urs Steiner, Branford, CT (US); Keith Ferrara, Stratford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 15/169,952

(22) Filed: Jun. 1, 2016

(65) Prior Publication Data

US 2016/0365235 A1 Dec. 15, 2016

Related U.S. Application Data

(63) Continuation of application No. 14/291,417, filed on May 30, 2014, now Pat. No. 9,384,954.

(60) Provisional application No. 61/829,937, filed on May 31, 2013, provisional application No. 61/830,304, filed on Jun. 3, 2013.

(51) Int. Cl.

| | |
|---|---|
| ***H01J 49/40*** | (2006.01) |
| ***H01J 49/02*** | (2006.01) |
| ***H01J 49/24*** | (2006.01) |

(52) U.S. Cl.

CPC ..... *H01J 49/405* (2013.01); *H01J 49/02* (2013.01); *H01J 49/24* (2013.01); *H01J 49/40* (2013.01)

(58) Field of Classification Search

CPC ..... H01J 49/405; H01J 49/40; H01J 49/24; H01J 49/02

USPC ..... 250/281, 282, 283, 286, 287

See application file for complete search history.

(56) References Cited

U.S. PATENT DOCUMENTS

| | | | |
|---|---|---|---|
| 3,342,993 | A | 9/1967 | O'Halloran |
| 3,727,047 | A | 4/1973 | Janes |
| 4,587,432 | A | 5/1986 | Aitken |
| 5,160,840 | A | 11/1992 | Vestal |
| 5,559,327 | A | 9/1996 | Steiner |
| 6,049,077 | A | 4/2000 | Franzen |
| 6,107,628 | A | 8/2000 | Smith |
| 6,177,668 | B1 | 1/2001 | Hager |

(Continued)

FOREIGN PATENT DOCUMENTS

| | | |
|---|---|---|
| JP | 2005-285543 | 10/2005 |
| JP | 2006140064 | 6/2006 |

OTHER PUBLICATIONS

ISR/WO for PCT/US14/40172 dated Dec. 10, 2014.

(Continued)

*Primary Examiner* — Nicole Ippolito

(74) *Attorney, Agent, or Firm* — Rhodes IP PLC; Christopher R Rhodes

(57) ABSTRACT

Certain embodiments described herein are directed to time of flight tubes comprising a cylindrical tube comprising an inner surface and an outer surface, the cylindrical tube comprising an effective thickness and sized and arranged to couple to and support a reflectron assembly inside the cylindrical tube. In some configurations, the cylindrical tube further comprises a conductive material disposed on the inner surface of the cylindrical tube, the conductive material present in an effective amount to provide a field free region for ions when the conductive material is charged.

20 Claims, 12 Drawing Sheets

(56) References Cited

U.S. PATENT DOCUMENTS

| | | | | |
|---|---|---|---|---|
| 6,465,777 | B1 | 10/2002 | Rache | |
| 6,528,784 | B1 | 3/2003 | Tang | |
| 6,998,607 | B1 | 2/2006 | Davis | |
| 7,138,625 | B2 | 11/2006 | Overney | |
| 7,154,086 | B2 | 12/2006 | Laprade | |
| 9,384,954 | B2 * | 7/2016 | Chiappetta | H01J 49/40 |
| 2003/0071208 | A1 | 4/2003 | Hansen | |
| 2003/0230726 | A1 * | 12/2003 | Van der Veer | H01J 9/14 250/396 R |
| 2004/0036029 | A1 | 2/2004 | Bertsch | |
| 2004/0135080 | A1 | 7/2004 | Ouyang | |
| 2004/0183028 | A1 | 9/2004 | Laprade | |
| 2006/0043283 | A1 | 3/2006 | Davis | |
| 2006/0091308 | A1 | 5/2006 | Boyle | |
| 2008/0073516 | A1 * | 3/2008 | Laprade | C03C 4/14 250/293 |
| 2009/0321624 | A1 | 12/2009 | Fang | |
| 2012/0068064 | A1 | 3/2012 | Numata | |
| 2013/0009051 | A1 | 1/2013 | Park | |

OTHER PUBLICATIONS

ISR/WO for PCT/US14/040430 dated Jan. 13, 2015.
ISR/WO for PCT/US14/040445 dated Jan. 12, 2015.
IPRP for PCT/US14/039900 mailed on Apr. 6, 2015.
Supplementary Search Report and Written Opinion for EP14804426 dated Nov. 16, 2016.
Brock et al. Review of Scientific Instruments, AIP, Melville NY, vol. 71, No. 3, Mar. 1, 2000, pp. 1306-1318.
Bernhard et al. Rapid Communications in Mass Spectrometry. vol. 5, No. 4, Apr. 1, 1991, pp. 198-202.
Supplementary Search Report and Written Opinion for EP14804173 dated Nov. 2016.

* cited by examiner

TIME OF FLIGHT TUBES AND METHODS OF USING THEM

PRIORITY AND RELATED APPLICATIONS

This application is related to, and claims priority to, each of U.S. Provisional Application No. 61/829,937 filed on May 31, 2013 and to U.S. Provisional Application No. 61/830,304 filed on Jun. 3, 2013, the entire disclosure of each of which is hereby incorporated herein by reference for all purposes. This application is also related to commonly assigned U.S. provisional application 61/830,281 filed on Jun. 3, 2013 and entitled "REFLECTRONS AND METHODS OF PRODUCING AND USING THEM," the entire disclosure of which is hereby incorporated herein by reference for all purposes.

TECHNOLOGICAL FIELD

This application is related to mass spectrometry devices and methods of using them. More particularly, certain embodiments described herein are directed to time of flight tubes suitable for use in a mass spectrometer or other devices that receive ions.

BACKGROUND

Mass spectrometry separates species based on differences in the mass-to-charge (m/z) ratios of the ions.

SUMMARY

Certain features, aspects and embodiments described herein are directed to devices, systems and methods that include a time of flight tube, a time of flight tube/reflectron assembly and other similar components. While certain configurations, geometries and arrangements are described herein to facilitate a better understanding of the technology, the described configurations are merely representative of the many different configurations that may be implemented.

In one aspect, a time of flight tube comprising an inner tube, an outer tube, and an air gap between the inner tube and the outer tube is provided. In certain embodiments, the inner tube comprises an effective thickness and is sized and arranged to couple to and support a reflectron assembly inside the inner tube. In some configurations, the inner tube comprises a conductive material disposed on an inner surface of the inner tube, the conductive material present in an effective amount to provide a field free region for ions when the conductive material is charged. In certain instances, the outer tube surrounds the inner tube and is effective to insulate the inner tube and electrically isolate the inner tube.

In certain embodiments, the inner tube comprises a material with a coefficient of thermal expansion that is effective to maintain a substantially constant height of the inner tube during operation of the time of flight tube. In other embodiments, the coefficient of thermal expansion of the material is effective to permit longitudinal expansion of the inner tube by about two microns or less. In additional embodiments, the conductive material on the inner surface of the inner tube comprises a coated conductive material. In some instances, the outer surface of the inner tube is non-conductive. In certain configurations, the tube may further comprise a cap coupled to the inner tube. In other examples, the cap is effective to seal the inner tube to permit vacuum operation of the time of flight tube. In some embodiments, the cap is configured to receive a gasket to seal the cap to the inner tube. In other embodiments, the tube may further comprise a conductive element electrically coupled to the conductive material disposed on the inner surface of the inner tube. In some examples, the tube may comprise a second conductive element disposed on the inner surface of the inner tube, in which the second conductive element is electrically coupled to the first conductive element. In certain examples, the tube may comprise a contact assembly configured to contact the first conductive element to electrically couple the first conductive element to a power source. In other embodiments, the tube may comprise at least one heater coupled to an outer surface of the inner tube. In some embodiments, the tube may comprise a temperature sensor coupled to the outer surface of the inner tube. In additional embodiments, the tube may comprise a material with a coefficient of thermal expansion that is effective to maintain a substantially constant height of the inner tube during operation of the time of flight tube at a temperature provided by the at least one heater. In other instances, the tube comprises a plurality of longitudinal rods coupled to the inner tube. In some embodiments, the tube comprises a cap coupled to the inner tube, in which each of longitudinal rods is configured to couple to the cap at one end and to couple to a mass spectrometer at another end to retain the time of flight tube to the mass spectrometer and permit vacuum operation of the time of flight tube. In some examples, the cap comprises a power source coupled to the cap. In additional examples, the tube comprises at least one heater coupled to an outer surface of the inner tube and a temperature sensor coupled to the outer surface of the inner tube, in which the inner tube comprises a material with a coefficient of thermal expansion that is effective to maintain a substantially constant height of the inner tube during operation of the time of flight tube at a temperature provided by the at least one heater, and in which the coefficient of thermal expansion of the material is effective to permit longitudinal expansion of the inner tube by about two microns or less at the temperature provided by the at least one heater. In some examples, the inner tube comprises a glass, the conductive material disposed on the inner surface of the inner tube is a metal coating and the outer tube comprises a plastic.

In another aspect, a time of flight tube comprising a cylindrical tube comprising an inner surface and an outer surface, the cylindrical tube comprising an effective thickness and sized and arranged to couple to and support a reflectron assembly inside the cylindrical tube, the cylindrical tube further comprising a conductive material disposed on the inner surface of the cylindrical tube, the conductive material present in an effective amount to provide a field free region for ions when the conductive material is charged is described.

In certain embodiments, the cylindrical tube comprises a material with a coefficient of thermal expansion that is effective to maintain a substantially constant height of the cylindrical tube during operation of the time of flight tube. In other embodiments, the coefficient of thermal expansion of the material is effective to permit longitudinal expansion of the cylindrical tube by about two microns or less. In additional embodiments, the conductive material on the inner surface of the inner tube comprises a coated conductive material. In certain examples, the outer surface of the inner tube is non-conductive. In other examples, the tube may comprise a cap coupled to the cylindrical tube. In some embodiments, the cap is effective to seal the cylindrical tube to permit vacuum operation of the time of flight tube. In some examples, the cap is configured to receive a gasket to seal the cap to the cylindrical tube. In certain embodiments, the tube may comprise a conductive element electrically coupled to the conductive material disposed on the inner surface of the inner tube. In other embodiments, the tube may comprise a second conductive element disposed on the inner surface of the cylindrical tube, in which the second conductive element is electrically coupled to the first conductive element. In some examples, the tube comprises a contact assembly configured to contact the first conductive element to electrically couple the first conductive element to a power source. In other examples, the tube comprises at least one heater coupled to an outer surface of the cylindrical tube. In certain embodiments, the tube comprises a temperature sensor coupled to the outer surface of the cylindrical tube. In certain examples, the tube comprises a plurality of longitudinal rods coupled to the cylindrical tube. In some examples, the tube comprises a cap coupled to the cylindrical tube, in which each of longitudinal rods is configured to couple to the cap at one end and to couple to a mass spectrometer at another end to retain the time of flight tube to the mass spectrometer and permit vacuum operation of the time of flight tube. In certain embodiments, the cap further comprises a power source coupled to the cap. In other embodiments, the tube comprises at least one heater coupled to an outer surface of the cylindrical tube and a temperature sensor coupled to the outer surface of the cylindrical tube, in which the cylindrical tube comprises a material with a coefficient of thermal expansion that is effective to maintain a substantially constant height of the cylindrical tube during operation of the time of flight tube at a temperature provided by the at least one heater, and in which the coefficient of thermal expansion of the material is effective to permit longitudinal expansion of the cylindrical tube by about two microns or less at the temperature provided by the at least one heater. In other examples, the cylindrical tube comprises a glass, and the conductive material disposed on the inner surface of the cylindrical tube is a metal coating.

In an additional aspect, a time of flight tube assembly comprising an inner tube comprising an effective thickness and sized and arranged to couple to and support a reflectron assembly inside the inner tube, the inner tube comprising a conductive material disposed on an inner surface of the inner tube, the conductive material present in an effective amount to provide a field free region for ions when the conductive material is charged, an outer tube surrounding the inner tube, the outer tube effective to insulate the inner tube and electrically isolate the inner tube, an air gap between the inner tube and the outer tube, and a reflectron assembly coupled to the inner tube, the reflectron assembly comprising a lens stack is provided.

In certain embodiments, the inner tube comprises a material with a coefficient of thermal expansion that is effective to maintain a substantially constant height of the inner tube during operation of the time of flight tube. In other embodiments, the coefficient of thermal expansion of the material is effective to permit longitudinal expansion of the inner tube by about two microns or less. In additional embodiments, the conductive material on the inner surface of the inner tube comprises a coated conductive material. In certain examples, the outer surface of the inner tube is non-conductive. In some examples, the assembly comprises a cap coupled to the inner tube. In some embodiments, the cap is effective to seal the inner tube to permit vacuum operation of the time of flight tube. In additional embodiments, the cap is configured to receive a gasket to seal the cap to the inner tube. In other embodiments, the assembly comprises a conductive element electrically coupled to the conductive material disposed on the inner surface of the inner tube. In some examples, the assembly comprises a second conductive element disposed on the inner surface of the inner tube, in which the second conductive element is electrically coupled to the first conductive element. In certain examples, the assembly comprises a contact assembly configured to contact the first conductive element to electrically couple the first conductive element to a power source. In other examples, the assembly comprises at least one heater coupled to an outer surface of the inner tube. In further examples, the assembly comprises a temperature sensor coupled to the outer surface of the inner tube. In certain examples, the assembly comprises a plurality of longitudinal rods coupled to the inner tube. In other examples, the assembly comprises each lens of the lens stack of the reflectron assembly comprises a planar conductive body comprising a first surface and a second surface, the planar body comprising an aperture between a first side and a second side of the first surface of the planar body, the planar body further comprising a plurality of conductors spanning the aperture from the first side to the second side of the first surface of the planar body, each of the plurality of conductors attached to the planar body at the first side and at the second side of the first surface, in which the plurality of conductors are each substantially parallel to each other and are positioned in the same plane. In certain embodiments, the assembly comprises a plurality of transverse rods coupled to each lens of the lens stack. In other embodiments, each lens of the lens stack of the reflectron assembly comprises a first planar body comprising a first surface and a second surface, the first planar body comprising an aperture between a first side and a second side of the first surface of the first planar body, the first planar body further comprising a plurality of conductors spanning the aperture from the first side to the second side of the first surface of the first planar body, each of the plurality of conductors attached to the first surface of the first planar body at the first side and at the second side of the first surface, in which the plurality of conductors are each substantially parallel to each other and are positioned in the same plane, in which the first planar body further comprises a conductive element disposed on the first surface of the first planar body and in contact with each of the plurality of conductors to permit current flow from the planar conductive body to the plurality of conductors. In further embodiments, the assembly comprises a plurality of transverse rods coupled to each lens of the lens stack.

In another aspect, a time of flight tube assembly comprising a cylindrical tube comprising an inner surface and an outer surface, the cylindrical tube comprising an effective thickness and sized and arranged to couple to and support a reflectron assembly inside the inner tube, the inner tube further comprising a conductive material disposed on the inner surface of the inner tube, the conductive material present in an effective amount to provide a field free region for ions when the conductive material is charged, and a reflectron assembly coupled to the cylindrical tube, the reflectron assembly comprising a lens stack is disclosed.

In certain embodiments, the cylindrical tube comprises a material with a coefficient of thermal expansion that is effective to maintain a substantially constant height of the cylindrical tube during operation of the time of flight tube. In other embodiments, the coefficient of thermal expansion of the material is effective to permit longitudinal expansion of the cylindrical tube by about two microns or less. In some embodiments, the conductive material on the inner surface of the inner tube comprises a coated conductive material. In certain examples, the outer surface of the inner tube is non-conductive. In other examples, the assembly comprises a cap coupled to the cylindrical tube. In some embodiments, the cap is effective to seal the cylindrical tube to permit vacuum operation of the time of flight tube. In certain embodiments, the cap is configured to receive a gasket to seal the cap to the cylindrical tube. In other embodiments, the assembly comprises a conductive element electrically coupled to the conductive material disposed on the inner surface of the inner tube. In certain examples, the assembly comprises a second conductive element disposed on the inner surface of the cylindrical tube, in which the second conductive element is electrically coupled to the first conductive element. In certain embodiments, the assembly comprises a contact assembly configured to contact the first conductive element to electrically couple the first conductive element to a power source. In some examples, the assembly comprises at least one heater coupled to an outer surface of the cylindrical tube. In some embodiments, the assembly comprises a temperature sensor coupled to the outer surface of the cylindrical tube. In some examples, the cylindrical tube comprises a material with a coefficient of thermal expansion that is effective to maintain a substantially constant height of the cylindrical tube during operation of the time of flight tube at a temperature provided by the at least one heater. In certain examples, the assembly comprises a plurality of longitudinal rods coupled to the cylindrical tube. In certain embodiments, each lens of the lens stack of the reflectron assembly comprises a planar conductive body comprising a first surface and a second surface, the planar body comprising an aperture between a first side and a second side of the first surface of the planar body, the planar body further comprising a plurality of conductors spanning the aperture from the first side to the second side of the first surface of the planar body, each of the plurality of conductors attached to the planar body at the first side and at the second side of the first surface, in which the plurality of conductors are each substantially parallel to each other and are positioned in the same plane. In other embodiments, the assembly comprises a plurality of transverse rods coupled to each lens of the lens stack. In some instances, each lens of the lens stack of the reflectron assembly comprises a first planar body comprising a first surface and a second surface, the first planar body comprising an aperture between a first side and a second side of the first surface of the first planar body, the first planar body further comprising a plurality of conductors spanning the aperture from the first side to the second side of the first surface of the first planar body, each of the plurality of conductors attached to the first surface of the first planar body at the first side and at the second side of the first surface, in which the plurality of conductors are each substantially parallel to each other and are positioned in the same plane, in which the first planar body further comprises a conductive element disposed on the first surface of the first planar body and in contact with each of the plurality of conductors to permit current flow from the planar conductive body to the plurality of conductors. In further embodiments, the assembly comprises a plurality of transverse rods coupled to each lens of the lens stack.

In an additional aspect, a kit comprising a first tube comprising an effective thickness and sized and arranged to couple to and support a reflectron assembly inside the first tube, the first tube comprising a conductive material disposed on an inner surface of the first tube, the conductive material present in an effective amount to provide a field free region for ions when the conductive material is charged, a second tube configured to surround the first tube, the second tube effective to insulate the first tube and electrically isolate the first tube, and instructions for using the first tube and the second tube to assemble a time of flight tube is provided.

In certain embodiments, the kit comprises at least one conductive element configured to couple to the conductive material disposed on the inner surface of the first tube. In other embodiments, the kit comprises a second conductive element configured to couple to the conductive material, in which the second conductive element is configured to electrically couple to the at least one conductive element. In certain examples, the kit comprises a contact assembly configured to contact the at least one conductive element to electrically couple the at least one conductive element to a power source. In other examples, the kit comprises a plurality of longitudinal rods configured to couple to the first tube. In some embodiments, the kit comprises a reflectron assembly. In some examples, the kit comprises at least one heater configured to couple to an outer surface of the first tube. In certain examples, the kit comprises at least one temperature sensor configured to couple to an outer surface of the first tube. In other examples, the kit comprises a cap configured to couple to the first tube and the second tube to permit vacuum operation of the time of flight tube. In some embodiments, the kit comprises a power source configured to couple to the cap.

In another aspect, a kit comprising a cylindrical tube comprising an inner surface and an outer surface, the cylindrical tube comprising an effective thickness and sized and arranged to couple to and support a reflectron assembly inside the inner tube, the cylindrical tube further comprising a conductive material disposed on the inner surface of the cylindrical tube, the conductive material present in an effective amount to provide a field free region for ions when the conductive material is charged, and instructions for using the cylindrical tube to assemble a time of flight tube is disclosed.

In certain examples, the kit comprises at least one conductive element configured to couple to the conductive material disposed on the inner surface of the cylindrical tube. In other examples, the kit comprises a second conductive configured to couple to the conductive material, in which the second conductive element is configured to electrically couple to the at least one conductive element. In some embodiments, the kit comprises a contact assembly configured to contact the first conductive element to electrically couple the first conductive element to a power source. In certain embodiments, the kit comprises a plurality of longitudinal rods configured to couple to the cylindrical tube. In certain examples, a reflectron assembly. In other examples, the kit comprises at least one heater configured to couple to an outer surface of the cylindrical tube. In certain embodiments, the kit comprises at least one temperature sensor configured to couple to an outer surface of the cylindrical tube. In some examples, the kit comprises a cap configured to couple to the cylindrical tube to permit vacuum operation of the time of flight tube. In certain examples, the kit comprises a power source configured to couple to the cap.

In an additional aspect, a method of removing a time of flight tube from an instrument, the method comprising disengaging the time of flight tube from an instrument housing, and lifting the time of flight tube vertically by about six inches or less to remove the time of flight tube from the instrument. Compared to existing time of flight tubes, which typically require lifting of the tube over the entire reflectron assembly for removal, disassembly of the time of flight tubes described herein is simplified.

Additional features, aspect, examples and embodiments are described in more detail below.

BRIEF DESCRIPTION OF THE FIGURES

Certain embodiments of the devices and systems are described with reference to the accompanying figures in which.

It will be recognized by the person of ordinary skill in the art, given the benefit of this disclosure, that certain dimensions or features of the components of the systems may have been enlarged, distorted or shown in an otherwise unconventional or non-proportional manner to provide a more user friendly version of the figures. In addition, the exact length and width of the tubes described herein may vary depending, for example, on the size of the reflectron, the desired ion flight path and other considerations.

DETAILED DESCRIPTION

Certain embodiments are described below with reference to singular and plural terms in order to provide a user friendly description of the technology disclosed herein. These terms are used for convenience purposes only and are not intended to limit the devices, methods and systems described herein.

In certain configurations, the time of flight tubes described herein may be low cost and light weight for cost sensitive time of flight mass spectrometers. While certain embodiments are described herein as time of flight tubes including glass materials, other insulative and support materials such as plastics, fiber-reinforced plastics, Kovar alloys or materials or other suitable materials can be used in the time of flight tubes. In particular, the material used in the cylindrical inner tube of the time of flight tubes desirably has a low coefficient of thermal expansion such that the overall height of the time of flight tube does not change during operation of the mass spectrometer. In some embodiments, the time of flight tube may include an insulative support sleeve that is configured to surround and/or support a reflectron assembly, e.g., a reflectron assembly as described herein. In some embodiments, the time of flight tube may include several attributes, including but not limited to, an effective thickness to support the reflectron, a low Coefficient of thermal Expansion (CTE) so it is very stable over any temperature variations a lab may experience, smooth ends to seal an O-ring and support high vacuum, a metalizing coating or sleeve to create a field free region for the ions, and electrically insulating between the inner wall and the outer wall so it is safe to touch during operation.

Figures 1A, 1B:
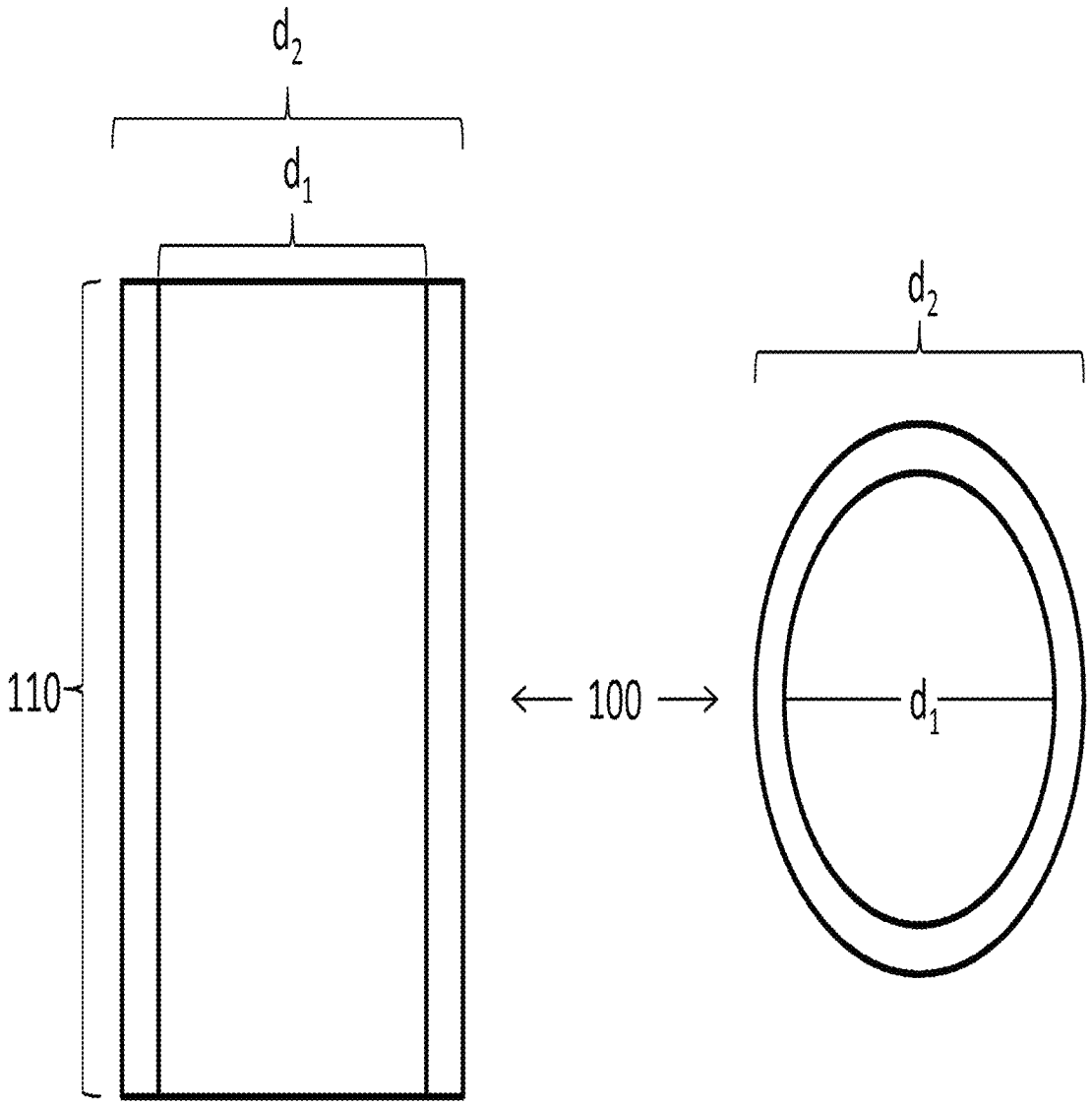
FIGS. 1A and 1B are illustrations of a cylindrical tube, in accordance with certain examples.

In certain examples, a time of flight tube generally comprises a cylindrical tube comprising an inner surface and an outer surface. Referring to FIGS. 1A and 1B, a cross-sectional view and a top view, respectively, of a cylindrical tube 100 is shown. The tube 100 comprises an effective inner diameter $d_1$ to permit insertion of a reflectron assembly into the tube. The wall thickness of the tube, e.g., the difference between the inner diameter $d_1$ and the outer diameter $d_2$, is desirably thick enough to be able to support the weight of the reflectron assembly, which as discussed herein, typically couples to the tube 100 through a cap mounted to an upper surface of the tube 100. The tube has a height 110 which is selected based, in part, on the length of the reflectron assembly, the desired flight path length or other considerations. While the overall height 110 of the tube 110 is not critical, the materials present in the tube 100 desirably do not expand to such a degree that the overall time height 110 substantially changes after the tube has been calibrated. For example, if materials are present in the tube that have a high coefficient of thermal expansion, the height 110 of the tube 100 may change during time of flight measurements, which can lead to inconsistent measurements. In some configurations, the tube 100 is heated to an operating temperature. While the operating temperature may fluctuate slightly, the materials present in the tube 100 desirably do not expand more than a selected amount, e.g., 1-2 microns or less, in the longitudinal direction of the tube 100 during operation to provide for increased precision.

In certain embodiments, the exact material used in the tube 100 may vary depending, for example, on the desired weight of the tube, the cost of the tube or other factors. In some embodiments, the tube 100 may comprise one or more glass materials including, but not limited to, non-silicate glasses or silicate glasses such as, for example, fused silica glasses, borosilicate glasses, quartz glasses, lead-oxide glasses, aluminosilicate glasses or other suitable silicate glasses. In some embodiments, the material of the tube 100 may comprise a ceramic material, a nonporous plastic material or other materials. As described in more detail below, an outer surface of the tube 100 is desirably non-conductive such that a user of an instrument comprising the time of flight tube will not be subjected to possible electrical shock if they contact the outer surface of the tube 100. By using a glass material, potential electrical shock can be avoided and production costs can be low.

Figures 2A, 2B:
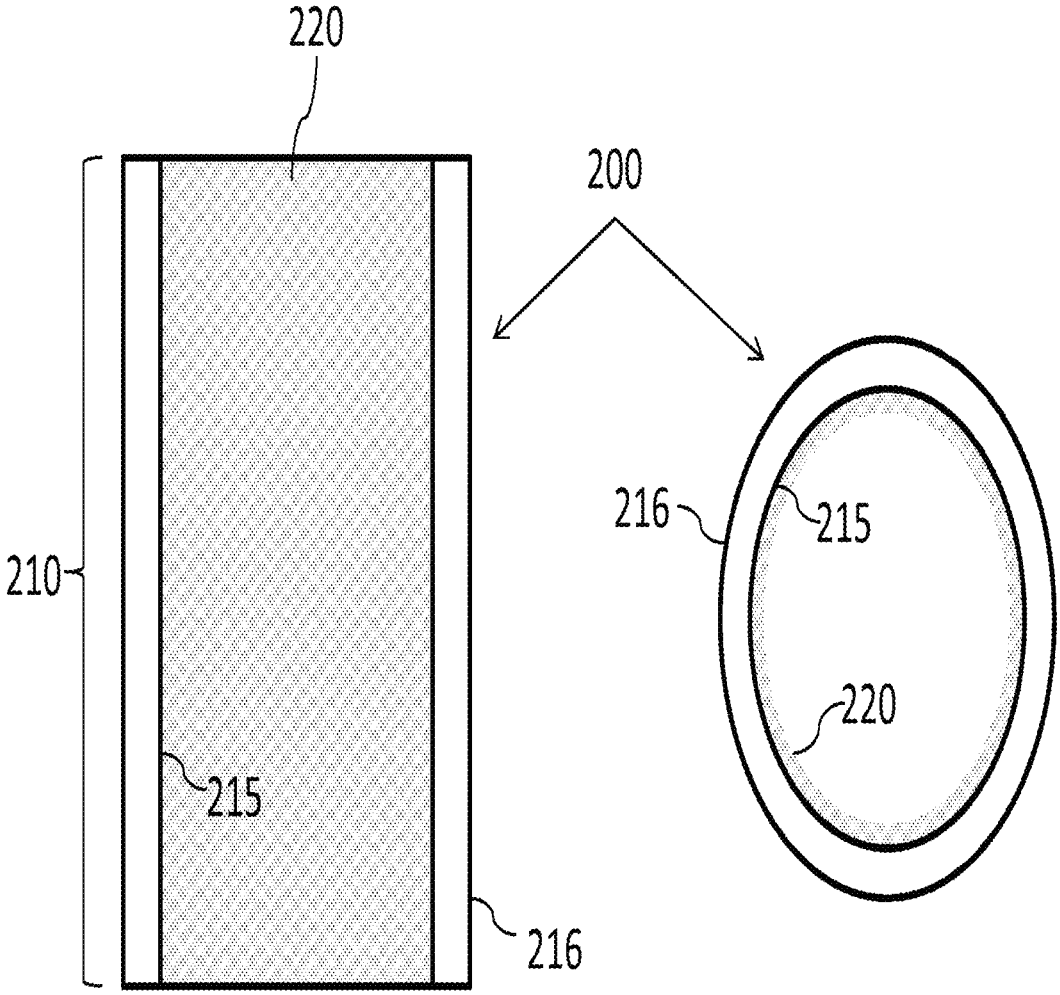
FIGS. 2A and 2B are illustrations of a cylindrical tube comprising a conductive material on an inner surface, in accordance with certain examples.

In certain instances, the cylindrical tube may comprise a conductive material disposed on the inner surface of the tube. Referring to FIGS. 2A (cross-section) and 2B (top view), a conductive material 220 can be present on the inner surface 215 of the tube 200 along a desired length 210 of the tube 200. The outer surface 216 of the tube 200 generally does not include a conductive material 220 and is effective to electrically insulate the conductive material 220 such that a current applied to the conductive material 220 is not provided to the outer surface 216 of the tube 200, e.g., the outer surface 216 is uncharged or is at ground. The presence of a conductive material 220 on the inner surface 215 of the tube 200 permits application of an electrical potential along the length 210 of the tube 200. Application of an effective potential, e.g., 1-5 kV, 1-4 kV, 2-4, kV or about 2 kV or about 3 kV, can provide a field free region within the tube 200 to permit ion flight within the tube 200 toward a reflectron (not shown) or from a reflectron. For example, the field-free region can permit ions to drift and separate based on their mass-to-charge (m/z) ratios. In some embodiments, the conductive material 220 may be present along the entire length of the tube 200, whereas in other embodiments, the conductive material may only be present at the lower portion of the tube 200 below the area where the reflectron may reside.

In certain embodiments, the conductive material present on the inner surface of the cylindrical tube may be coated, sprayed, brushed on, vapor deposited or otherwise deposited on the inner surface of the tube to a desired thickness. Where the conductive material is present as a coating on the inner surface of the tube, the coating may be about 1000-2000 Angstroms, for example. In certain embodiments, the thickness of the coating may vary at different portions of the tube, e.g., one or more portions may be present at a thicker amount in the form of a wire to account for any higher resistance in different areas of the tube. In some embodiments, the conductive material may take the form of a conductive sleeve which inserts into the cylindrical tube and may couple to the cylindrical tube through the use of an adhesive, welds, fasteners or other attachment methods. In other configurations, the conductive sleeve may "float" within the cylindrical tube such that it does not make direct contact with the inner surfaces of the cylindrical tube. In some instances, the sleeve may be formed using a thin sheet of conductive material and curling the material to confirm to the inner surface of the tube. In certain examples, the conductive material may comprise gold, silver, copper, titanium, aluminum, tungsten or alloys of any of these metals or other suitable conductive metals or materials. In other configurations, the conductive material or particles may be embedded or disposed within the inner surfaces of the cylindrical tube to permit the inner surface of the tube to be conductive without the need to coat or dispose a conductive material on the inner surface of the tube.

Figure 3A:
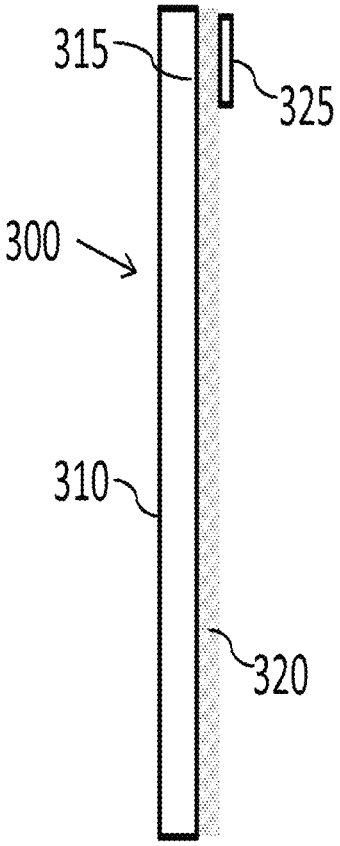
FIGS. 3A and 3B are illustration of a cylindrical tube comprising a conductive material on an inner surface and a conductive element electrically coupled to the conductive material, in accordance with certain examples.
Figure 3B:
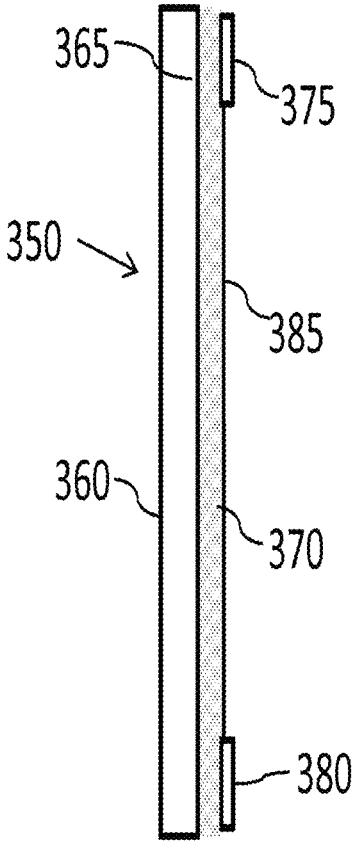

In certain embodiments, the tube may comprise a conductive element, also referred to herein as a conductive block, that may electrically couple to the conductive material on the inner surface of the tube to provide a charge to the conductive material. Referring to FIG. 3A, a side view of a tube 300 is shown that shows the tube wall 310, a conductive material 320 disposed on the inner surface 315 of the tube wall and a conductive element 325 electrically coupled to the conductive material 320. The conductive element 325 may take the form of a block, a contact or other forms that can permit current to flow from a power source (not shown) to the conductive material 320 of the tube 300. In some embodiments, to reduce the likelihood of a voltage drop along the length of the conductive material, it may be desirable to include a second conductive element. Referring to FIG. 3B, a side view of a tube 350 that comprises a tube wall 360, a conductive material 370 disposed on the inner surface 365 of the tube wall 360, a first conductive element 375 electrically coupled to the conductive material 370 and a second conductive element 380 electrically coupled to the conductive material 370. If desired, the first and second conductive elements 375, 380 may be electrically coupled to each other through an interconnect or lead 385 to provide for a more uniform delivery of current to the conductive material 370. A contact may be present on a cap or lid that couples to the top of the tube 300 (or tube 350). When the cap or lid is coupled to the tube, the contact may rest against the conductive element 325 (or conductive element 375) to provide a current from a power source to the conductive element 325 and to the conductive material 320.

Figure 4A:
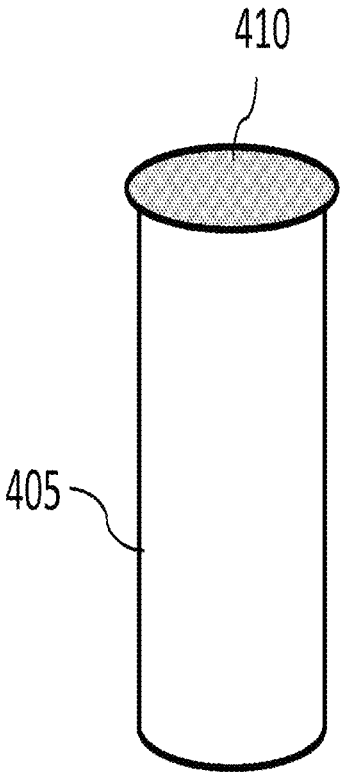
FIG. 4A is an illustration of a cylindrical tube coupled to a cap, in accordance with certain examples.
Figure 4B:
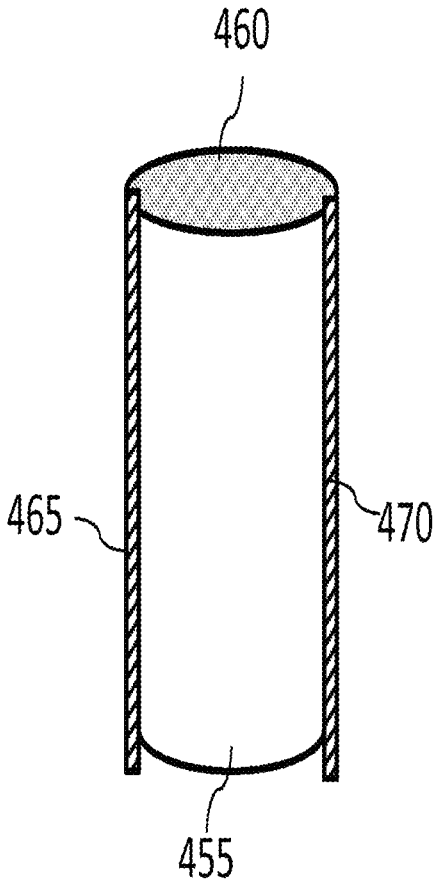
FIG. 4B is an illustration of a cylindrical tube coupled to a cap through longitudinal rods, in accordance with certain examples.

In certain examples, the cap or lid of the tube may be configured to seal the interior of the tube such that a vacuum may be provided within the tube for operation of the tube at a pressure less than atmospheric pressure, e.g., operation at a pressure of about $10^{-8}$ Torr. Referring to FIG. 4A, a cap or lid 410 is shown as being coupled to a tube 405. The cap 410 may include a groove or opening in its bottom surface to receive a gasket or O-ring (not shown) that can rest against the top surface of the tube 405 and can seal the tube 405 to the cap 410. In some embodiments, the cap 410 may comprise openings or fittings that can receive longitudinal rods that can compress the cap 410 to the top surface of the tube 405. For example and referring to FIG. 4B, a tube 455 is coupled to a cap 460 through longitudinal rods 465, 470. While not shown, one end of the longitudinal rods 465, 470 couples to an instrument housing or a portion thereof. The longitudinal rods 465, 470 are effective to apply a compressive force between the tube 455 and the cap 460 and between the tube 455 and the instrument housing to seal the interior volume of the tube 455 and permit vacuum operation. For example, the longitudinal rods may include terminal threads that can engage a fastener, e.g., a nut, to permit tightening of the cap 410 and/or instrument housing to the tube 455. If desired, a gasket or O-ring may be present between the instrument housing and the bottom end of the tube 455 to enhance the vacuum seal.

Figure 5A:
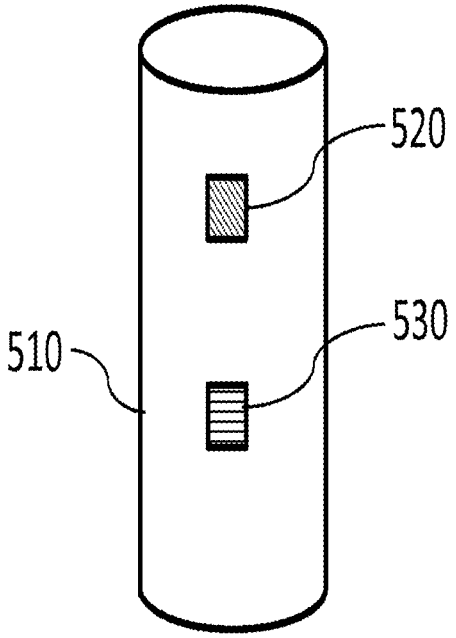
FIGS. 5A and 5B are illustrations of a cylindrical tube coupled to a heater and a temperature sensor, in accordance with certain examples.

In certain configurations, the tube may be thermally coupled to one or more heaters or heating elements to control the temperature of the tube material, e.g., to maintain a substantially constant tube temperature during operation of the instrument. For example and referring to FIG. 5A, a tube 510 is shown that is thermally coupled to a heater 520. In the configuration of FIG. 5A, the heater 520 is positioned on an external surface of the tube 510. The heater 520 is typically electrically coupled to a power source such that current may be provided to the heater to either provide the heating or control the heater or both. In some embodiments, the heater 520 may take the form of a resistive heating element which can be controlled by the amount of current provided to the heater. In some embodiments, a temperature sensor 530 may also be present to provide some feedback regarding the actual temperature of the tube surface. A shown in FIG. 5A, the temperature sensor 530 may be mounted to the exterior surface of the tube 510. In some embodiments, the tube 510 may comprise more than one heater thermally coupled to it, e.g., two, three, four or more heaters may be present. Similarly, if desired, more than a single temperature sensor 530 may also be present. In some instances, a heating sleeve or heating wrap may be present and thermally coupled to the tube 510 at least at some portion.

Figure 5B:
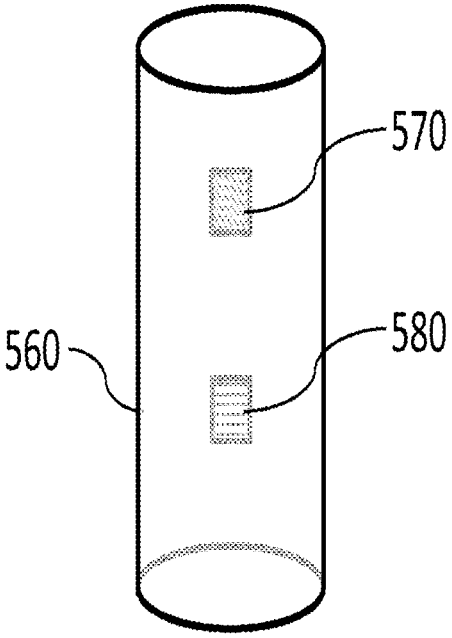

In certain instances, it may be desirable to position one or both of the heater or the temperature sensor on the interior of the tube to provide for more accurate temperature control of the tube. For example, the thick walls of the tube which are designed to support the weight of the reflectron may make it more difficult to control the interior temperature within the tube due to slow thermal transfer from the heater outside of the tube. Referring to FIG. 5B, a tube 560 comprises a heater 570 and a temperature sensor 580 disposed on the inner surface of the tube 560. Suitable electrical connections may be provided through a feed-through or aperture in the cap (not shown) to provide power to the heater 570 and the sensor 580 without disrupting the vacuum operation of the tube 560.

In certain embodiments, the cylindrical tube may couple to and house a reflectron assembly. For example and referring to FIG. 6, a time of flight tube 610 comprising a reflectron assembly 620 is shown. The reflectron assembly 620 is positioned within the tube 610. A cap or lid 625 is shown as being coupled to the top of the tube 610 through a longitudinal rod 640. A power source 630 is disposed on the cap 625 and electrically coupled to a conductive material (not shown) on the interior surface of the tube 610. The power source 630 can be electrically coupled to components within the tube 610, e.g., the conductive material and/or components outside of the tube, e.g., a heater, temperature sensor or other components. The assembly 600 comprises an assembly/disassembly block 626 that may be coupled to the tube 610. The block 626 is configured to permit removal of the entire assembly 600 from the instrument to service the assembly 600 or components of the instrument. For example, in many existing time of flight tubes, a conductive outer sleeve is present. The sleeve is charged and may provide an electrical shock to the user. In addition, to remove the sleeve, the sleeve must be lifted over the entire reflectron assembly of the instrument. In contrast, the time of flight tube described herein can be removed by lifting the time of flight tube/reflectron assembly a sufficient height, e.g., about 4-6 inches, to clear the components of the instrument. The time of flight tube/reflectron assembly may then be removed for service.

Figure 6:
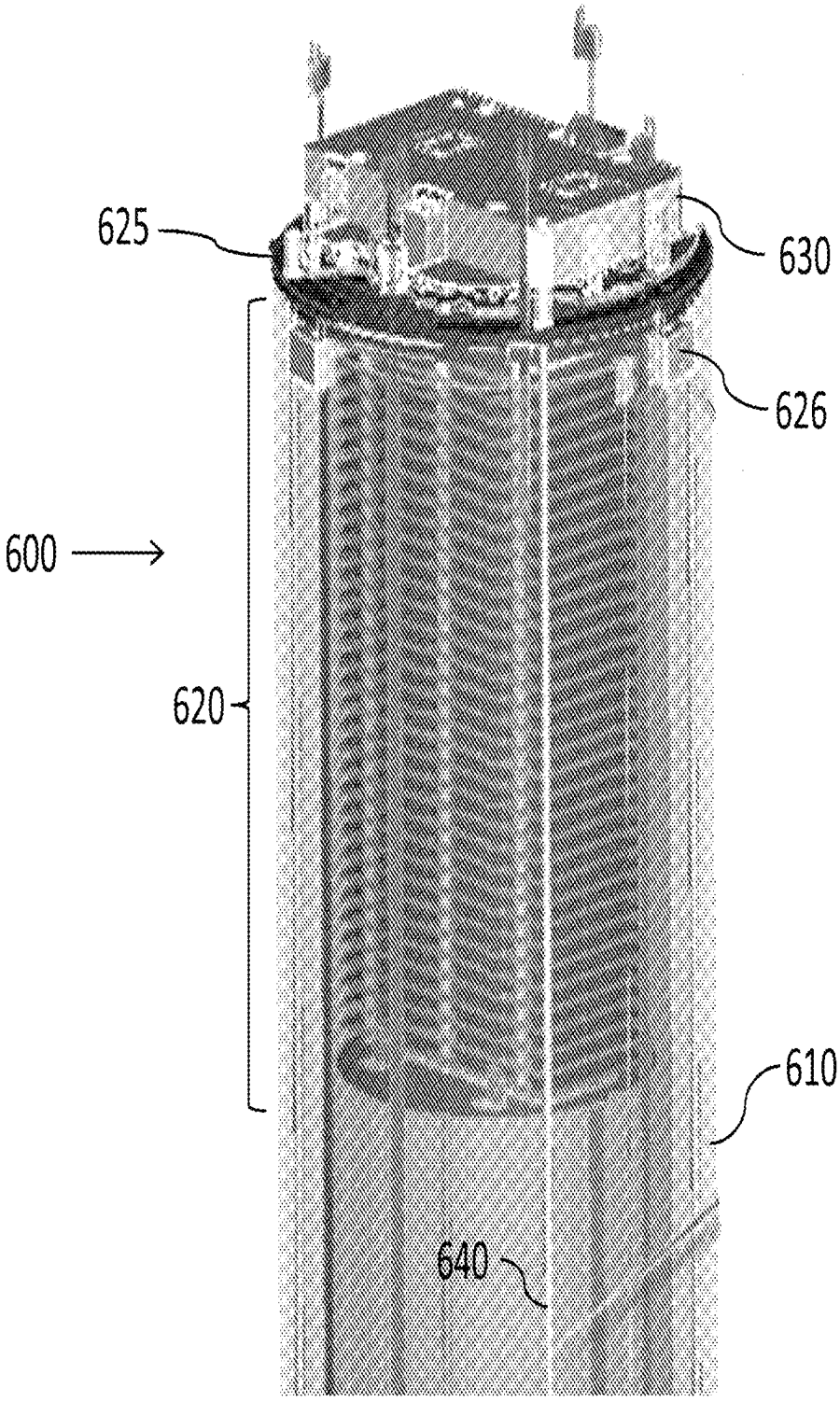
FIG. 6 is an illustration of a cylindrical tube with a reflectron assembly disposed in it, in accordance with certain examples.

As is shown in FIG. 6, the reflectron assembly 620 comprises a plurality of lenses coupled to each other through transverse rods. In some embodiments, each lens of the lens stack of the reflectron assembly comprises a first planar body comprising a first surface and a second surface, the first planar body comprising an aperture between a first side and a second side of the first surface of the first planar body, the first planar body further comprising a plurality of conductors spanning the aperture from the first side to the second side of the first surface of the first planar body, each of the plurality of conductors attached to the first surface of the first planar body at the first side and at the second side of the first surface, in which the plurality of conductors are each substantially parallel to each other and are positioned in the same plane, in which the first planar body further comprises a conductive element disposed on the first surface of the first planar body and in contact with each of the plurality of conductors to permit current flow from the planar conductive body to the plurality of conductors. Other configurations of reflectron assemblies are described, for example, in U.S. provisional application U.S. Provisional Application 61/830,281 filed on Jun. 3, 2013. Without wishing to be bound by any particular scientific theory, as ions enter into the time of flight tube 600 from the bottom of the tube 600, they initially traverse a zero field region prior to entry into the reflectron assembly 620. Once the ions enter into the reflectron assembly 620, they eventually reverse their trajectory and head back toward the bottom of the reflectron assembly 620 and the tube 600 where they arrive at a detector (not shown). The time from entry of the ion into the tube 600 until arrival at the detector is the time of flight, which can be used along with a calibration or lookup table to determine the ions mass-to-charge ratio and/or identity.

Figures 7A, 7B:
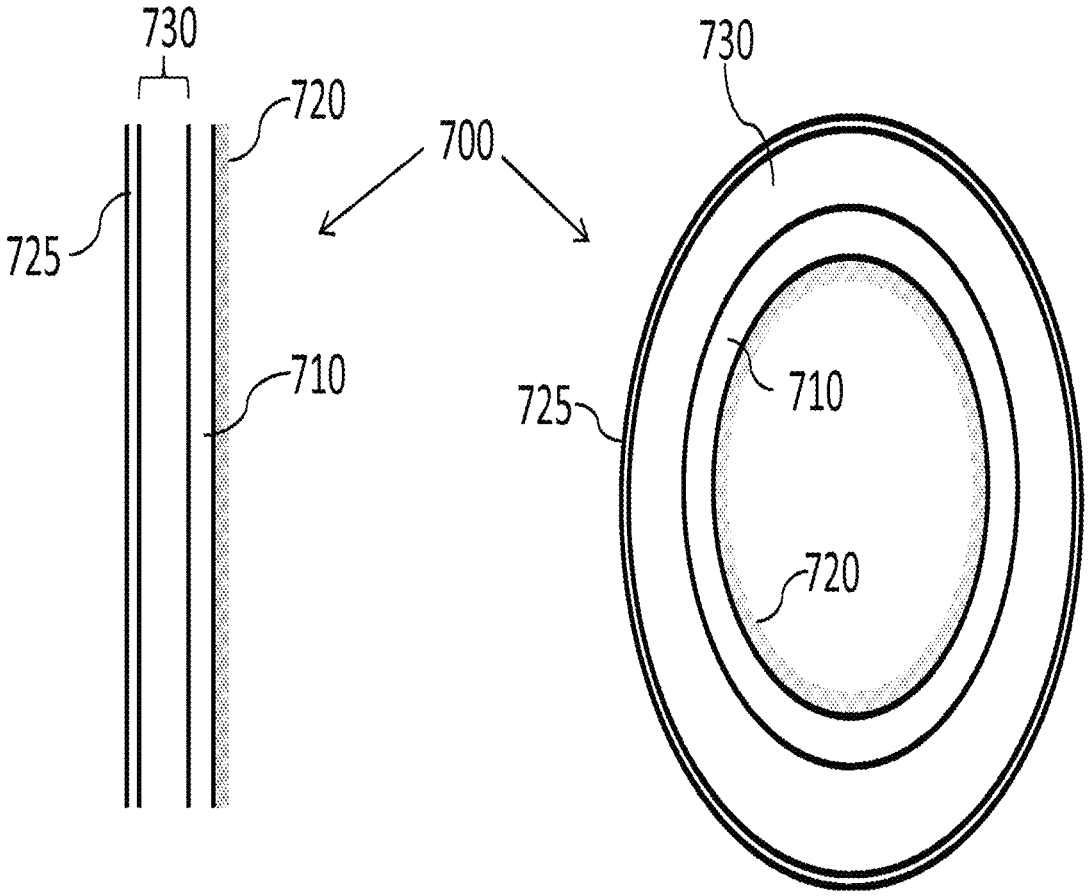
FIGS. 7A and 7B are illustrations of a time of flight tube comprising an inner tube and an outer tube, in accordance with certain examples.

In certain embodiments, the time of flight tubes described herein may comprise a first, inner tube and a second, outer tube. If desired, an air gap may be present between the first tube and the second tube to permit placement of the heaters, temperature sensor, the longitudinal rods or other components of the flight tube. Referring to FIGS. 7A (side view) and 7B (top view), a time of flight tube 700 comprises an inner tube 710, an outer tube 725 and an air gap 730 between the inner tube 710 and the outer tube 725. A conductive material 720 is disposed on an inner surface of the inner tube 710. The air gap 730 can be sized and arranged to permit insertion of the heaters, heating sleeves or wraps, temperature sensors and/or longitudinal rods in the air space 730. In some examples, the air space 730 may also be effective to insulate the inner tube 710 to prevent air currents from contacting the inner tube. The outer tube 725 provides an additional physical barrier to prevent the user from contacting the inner tube 710, which comprises a charge on its inner surface through the conductive material 720. The outer tube 725 is also effective to assist in maintaining the temperature of the inner tube 710 substantially constant during operation of the time of flight tube 700 to avoid, or reduce the likelihood of, any change in the height of the inner tube 710. In some instances, the outer tube 725 may act as a thermal barrier and may include one or more insulative materials on an inner surface. In other instances, the air gap 730 may be omitted, and an insulative material may instead be present between the inner tube 710 and the outer tube 720. For example, a foam, cellulose material, fiberglass or other insulative material may be present between the outer tube 720 and the inner tube 710.

In certain examples, the inner tube 710 may comprise a material with a coefficient of thermal expansion that is effective to maintain a substantially constant height of the inner tube during operation of the time of flight tube, e.g., the material may be effective to permit longitudinal expansion of the tube 710 by no more than a small amount, e.g., 1-2 microns, or not at all at the operating temperature range of the time of flight tube 700. In some embodiments, the tube 710 may comprise one or more glass materials including, but not limited to, non-silicate glasses or silicate glasses such as, for example, fused silica glasses, borosilicate glasses, quartz glasses, lead-oxide glasses, aluminosilicate glasses or other suitable silicate glasses. In some embodiments, the material of the tube 710 may comprise a ceramic material, a nonporous plastic material or other materials. The presence of an outer tube 725 can permit the entire tube 710 to be conductive, but in some instances, an outer surface of the tube 710 is desirably non-conductive.

In other embodiments, the conductive material 720 can be present on the inner surface of the tube 710 along a desired length of the tube 710. The outer surface of the tube 710 generally does not include a conductive material 720 and is effective to electrically insulate the conductive material 720 such that a current applied to the conductive material 720 is not provided to the outer surface of the tube 700, e.g., the outer surface is uncharged or is at ground. The presence of a conductive material 720 on the inner surface of the tube 710 permits application of an electrical potential along the length of the tube 710. Application of an effective potential, e.g., 1-5 kV, 1-4 kV, 2-4, kV or about 2 kV or about 3 kV, can provide a field free region within the tube 710 to permit ion flight within the tube 710 toward a reflectron (not shown) or from a reflectron. In some embodiments, the conductive material 720 may be present along the entire length of the tube 710, whereas in other embodiments, the conductive material may only be present at the lower portion of the tube 710 below the area where the reflectron may reside.

In certain configurations, the tube 700 may comprise a cap coupled to a top surface of the tube, e.g., a cap similar to the cap 625 of FIG. 6. If desired, a gasket or O-ring may be present between the cap and the top surface of the tube 700 to enhance a fluid tight seal between the components. While not shown in FIG. 7, the tube 710 may also comprise one or more conductive elements disposed on an inner surface or an outer surface to provide electrical coupling between a power source and the conductive material 720 of the tube 710. Where a conductive element is present, a contact assembly may also be present to electrically couple the conductive element to a power source. In some instances, one or more heaters, temperature sensors or other components may be coupled to the inner surface or the outer surface of the tube 710. The tube 700 may also comprise a plurality of longitudinal rods coupled to the inner tube 710 to couple the inner tube to the cap (not shown) and an instrument housing (also not shown). In some embodiments, the inner tube 710 comprises a glass, the conductive material 720 is disposed on the inner surface of the inner tube 710 and is a metal coating, and the outer tube 725 comprises a plastic.

In certain instances, the components of the time of flight tubes described herein may be packaged in kit form for assembly at a distant site. In some examples, the kit may comprise a cylindrical tube comprising an inner surface and an outer surface, the cylindrical tube comprising an effective thickness and sized and arranged to couple to and support a reflectron assembly inside the inner tube, the cylindrical tube further comprising a conductive material disposed on the inner surface of the cylindrical tube, the conductive material present in an effective amount to provide a field free region for ions when the conductive material is charged, and instructions for using the cylindrical tube to assemble a time of flight tube. In other embodiments, the kit comprises one or more of at least one conductive element configured to couple to the conductive material disposed on the inner surface of the cylindrical tube and/or a second conductive element configured to couple to the conductive material, in which the second conductive element is configured to electrically couple to the at least one conductive element. In other examples, the kit may comprise, a contact assembly configured to contact the at least one conductive element to electrically couple the at least one conductive element to a power source. In additional examples, the kit may comprise a plurality of longitudinal rods configured to couple to the cylindrical tube. In further examples, the kit may comprise a reflectron assembly. In additional examples, the kit may comprise one or more of a heater configured to couple to an outer surface of the cylindrical tube, a temperature sensor configured to couple to an outer surface of the cylindrical tube, a cap configured to couple to the cylindrical tube to permit vacuum operation of the time of flight tube, and/or a power source configured to couple to the cap.

In other instances, the kit may comprise a first tube comprising an effective thickness and sized and arranged to couple to and support a reflectron assembly inside the first tube, the first tube comprising a conductive material disposed on an inner surface of the first tube, the conductive material present in an effective amount to provide a field free region for ions when the conductive material is charged, a second tube configured to surround the first tube, the second tube effective to insulate the first tube and electrically isolate the first tube, and instructions for using the first tube and the second tube to assemble a time of flight tube. In some embodiments, the kit may include one or more of at least one conductive element configured to couple to the conductive material disposed on the inner surface of the first tube, and/or a second conductive element configured to couple to the conductive material, in which the second conductive element is configured to electrically couple to the at least one conductive element. In other embodiments, the kit may include a contact assembly configured to contact the at least one conductive element to electrically couple the at least one conductive element to a power source. In certain examples, the kit may include a plurality of longitudinal rods configured to couple to the first tube. In other examples, the kit may include a reflectron assembly. In further examples, the kit may include one or more of a heater configured to couple to an outer surface of the first tube, a temperature sensor configured to couple to an outer surface of the first tube, a cap configured to couple to the first tube and the second tube to permit vacuum operation of the time of flight tube and/or a power source configured to couple to the cap.

Figure 8:
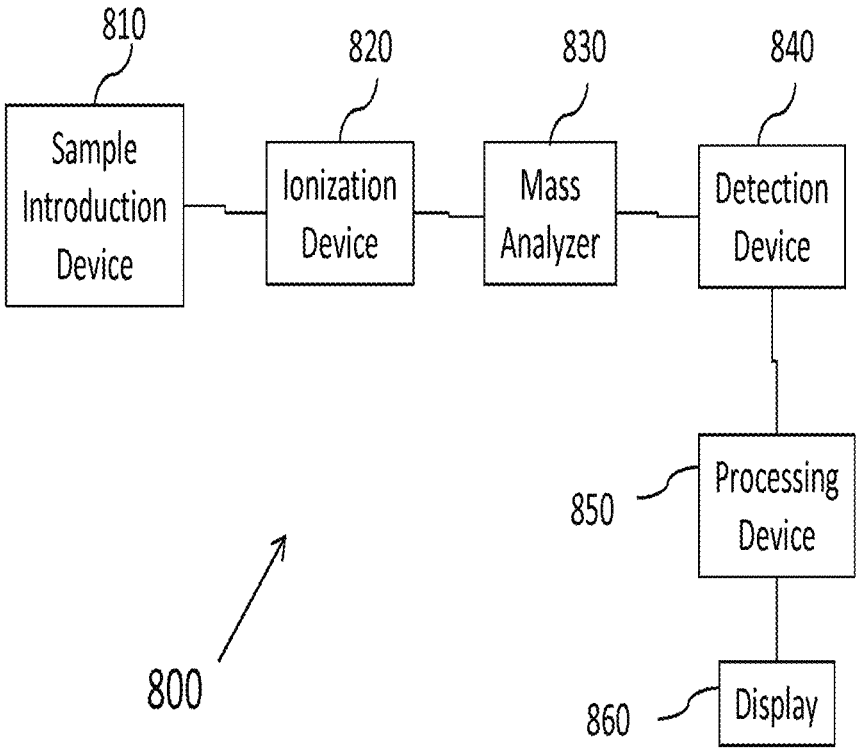
FIG. 8 is a block diagram of a mass spectrometer, in accordance with certain examples.

In certain embodiments, the time of flight tubes described herein can be used in a mass spectrometer. An illustrative MS device is shown in FIG. 8. The MS device 800 includes a sample introduction device 810, an ionization device 820, a mass analyzer 830, a detection device 840, a processing device 850 and a display 860. The sample introduction device 810, ionization device 820, the mass analyzer 830 and the detection device 840 may be operated at reduced pressures using one or more vacuum pumps. In certain examples, however, only the mass analyzer 830 and the detection device 840 may be operated at reduced pressures. The sample introduction device 810 may include an inlet system configured to provide sample to the ionization device 820. The inlet system may include one or more batch inlets, direct probe inlets and/or chromatographic inlets. The sample introduction device 810 may be an injector, a nebulizer or other suitable devices that may deliver solid, liquid or gaseous samples to the ionization device 820. The ionization device 820 may be any one or more ionization devices commonly used in mass spectrometer, e.g., may be any one or more of the devices which can atomize and/or ionize a sample including, for example, plasma (inductively coupled plasmas, capacitively coupled plasmas, microwave-induced plasmas, etc.), arcs, sparks, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 830 may take numerous forms depending generally on the sample nature, desired resolution, etc., and exemplary mass analyzers include the time of flight tubes and/or reflectrons described herein. The detection device 840 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. The processing device 850 typically includes a microprocessor and/or computer and suitable software for analysis of samples introduced into MS device 800. One or more databases may be accessed by the processing device 850 for determination of the chemical identity of species introduced into MS device 800. Other suitable additional devices known in the art may also be used with the MS device 800 including, but not limited to, autosamplers, such as AS-90plus and AS-93plus autosamplers commercially available from PerkinElmer Health Sciences, Inc.

In certain embodiments, the mass analyzer 830 of the MS device 800 may take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that may separate species with different mass-to-charge ratios. In some embodiments, two stages may be included where one stage comprises a time of flight tube as described herein.

In some examples, the MS devices disclosed herein may be hyphenated with one or more other analytical techniques. For example, MS devices may be hyphenated with devices for performing liquid chromatography, gas chromatography, capillary electrophoresis, and other suitable separation techniques. When coupling an MS device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces may be used so that only a small amount of sample exiting the liquid chromatograph may be introduced into the MS device. Sample exiting from the liquid chromatograph may also be deposited in suitable wires, cups or chambers for transport to the ionization devices of the MS device. In certain examples, the liquid chromatograph may include a thermospray configured to vaporize and aerosolize sample as it passes through a heated capillary tube. Other suitable devices for introducing liquid samples from a liquid chromatograph into a MS device will be readily selected by the person of ordinary skill in the art, given the benefit of this disclosure. In certain examples, MS devices can be hyphenated with each other for tandem mass spectroscopy analyses.

Certain specific examples of the time of flight tubes are described in the specific examples below.

Example 1

Figure 9:
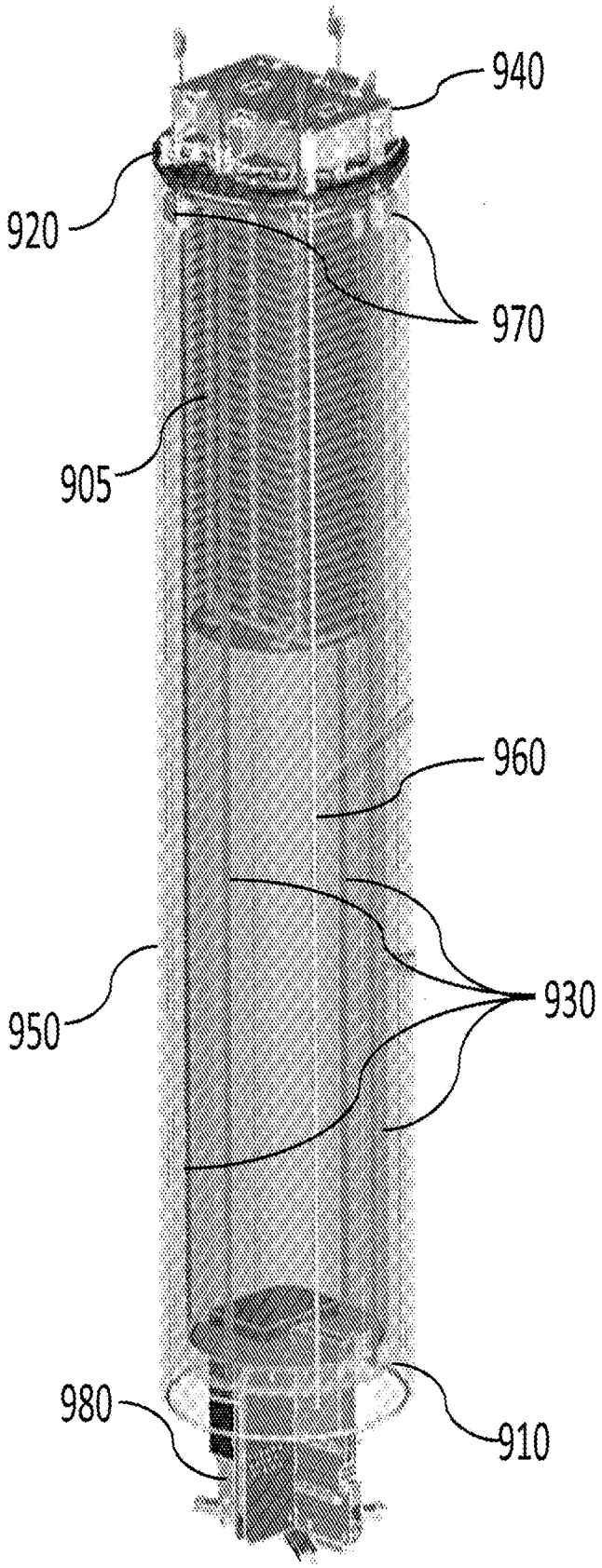
FIG. 9 is an illustration of a time of flight/reflectron assembly, in accordance with certain examples.

In certain embodiments, a time of flight tube may be sized and arranged to receive a reflectron assembly. For example and referring to FIG. 9, a time of flight (TOF) tube 910 produced from thick walled borosilicate glass may comprise a very low CTE and may include a conductive coating or sleeve, e.g., a conductive coating of gold, titanium, metal alloys or other conductive materials which are substantially inert or will not otherwise interfere with the TOF measurements, on the inside diameter having a selected electrical potential, e.g., an electrical potential of 2 KV, and with an uncoated outside diameter that is at ground potential. In some instances, a conductor, e.g., a metallized block or other suitable structure, protrudes from the inside diameter of the glass tube 910 to receive power from a cap 920 via a vacuum feed through located in the cap 920, e.g., which may be aluminum or other materials and which is also used to seal off the vacuum. In certain embodiments, this cap 920 has an O-ring groove to accept an O-ring (not shown) used to assist in creating a high vacuum within the TOF tube 910. In certain examples, both ends of the glass tube 910 have flat, smooth edges to seal against the O-ring to maintain high vacuum. In other examples, the outside diameter may include a suitable number of spaced heaters 930, e.g., 4 equally spaced, adhesive backed kapton resistive heaters, together with an adhesive backed resistance temperature detector (RTD) sensor coupled to a power source and electronics 940 used to control and maintain a stable temperature. For example, the glass tube 910 may be heated to a desired temperature, and the temperature can be maintained substantially constant to avoid expansion of the materials of the TOF tube. The cap 920 has electronics 940 mounted on top to power and control the heaters, power the reflectron 905 and to power status LED lights. In some embodiments, an outer tube 950, e.g., a plastic tube, is placed over the glass tube 910 creating an unsealed air gap between the outer diameter of the tube 910 and the inner diameter of the outer tube 950 which is used to protect the glass tube 910 from damage. In some configurations, a suitable number of tension rods, such as rod 960, e.g., two to four tension rods, are lowered thru holes in the cap 920 and air gap and into the vacuum chamber on the bottom where they are tightened to sandwich the tube 910 and compress the O-rings. A suitable number of blocks 970, e.g., two, three or four blocks, can be adhered to the top of the tube 950 (or the tube 910 or both) that protrude into slot in the outer tube 950 which are used to facilitate assembly/disassembly. By including these blocks 990 and slots, disassembly may occur without having to lift the entire outer tube 950 over the remainder of the tube 910 and reflectron assembly 905. With the blocks 970 and slots, the outer protective tube 950 and tube 910 together can be removed as a unit, thus minimizing the space needed for disassembly. A pulser/detector assembly 980 is shown as being coupled to the bottom of the tube 910.

Example 2

Figure 10:
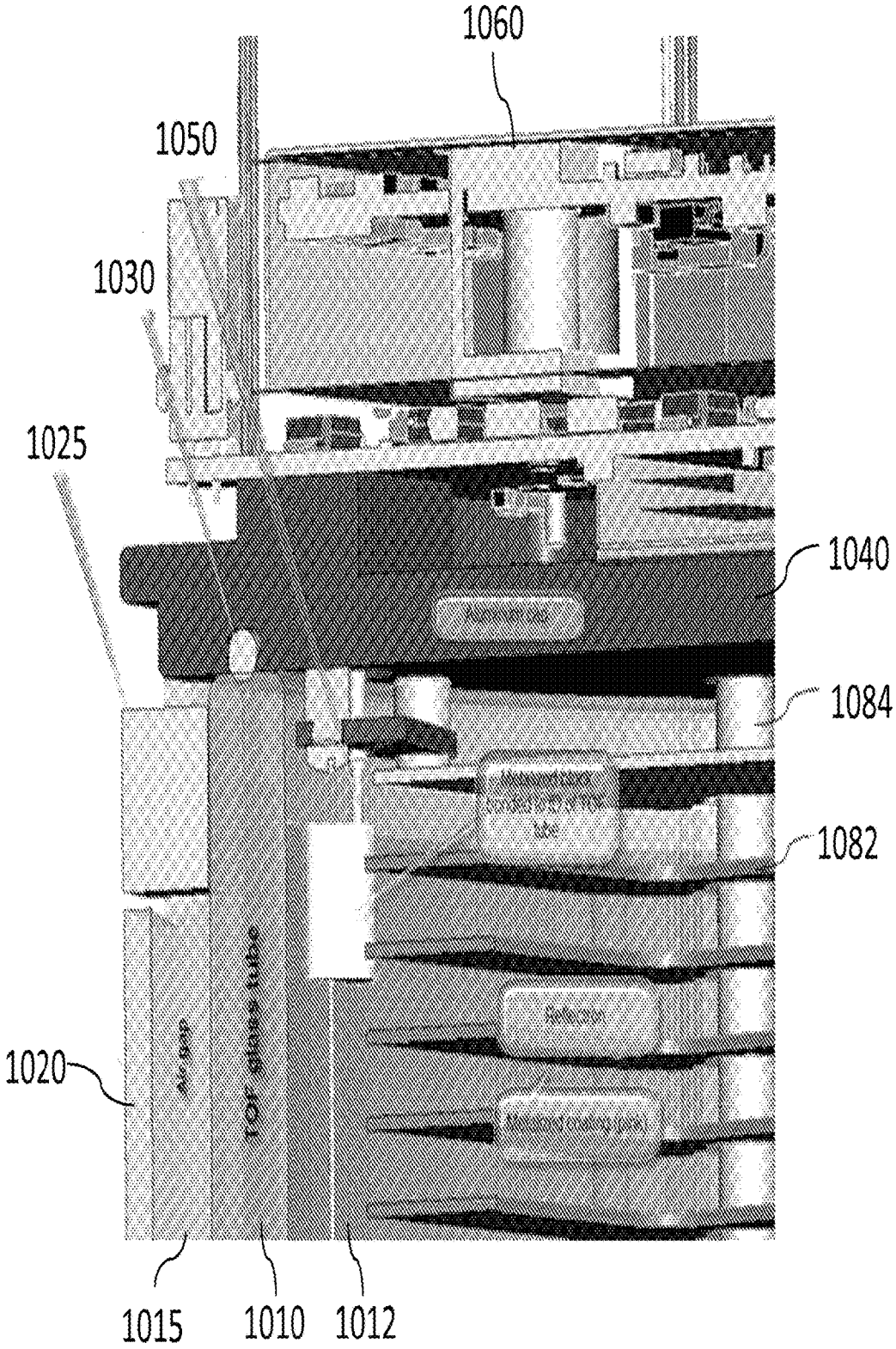
FIG. 10 is an expanded view of one side of a time of flight/reflectron assembly, in accordance with certain examples.

Referring to FIG. 10, an expanded view of a cross-sectional view of a time of flight tube is shown. An inner tube 1010 is separated from an outer tube 1020 by an air gap 1015. A block 1025 is bonded to the inner tube 1010 and protrudes into the outer tube 1020 to couple the two tubes 1010, 1020 to each other and generally seal the air space 1015 between the two tubes 1010, 1020. A cross-section of an O-ring 1030 is shown. The O-ring 1030 is placed into a groove of a cap 1040, e.g., an aluminum cap. The block 1025 is bonded to (or otherwise electrically coupled to) a conductive material 1012 coated on an inner surface of the inner tube 1010. A contact assembly comprises a spring or pogo pin 1050 that can engage a surface of the conductive block 1025 to electrically couple the conductive block 1025 to a power source 1060 mounted on the cap 1040. The reflectron assembly in the tube 1010 comprises a plurality of lenses, such as lens 1082, which are coupled to each other through transverse rods, such as transverse rod 1084.

Example 3

Figure 11:
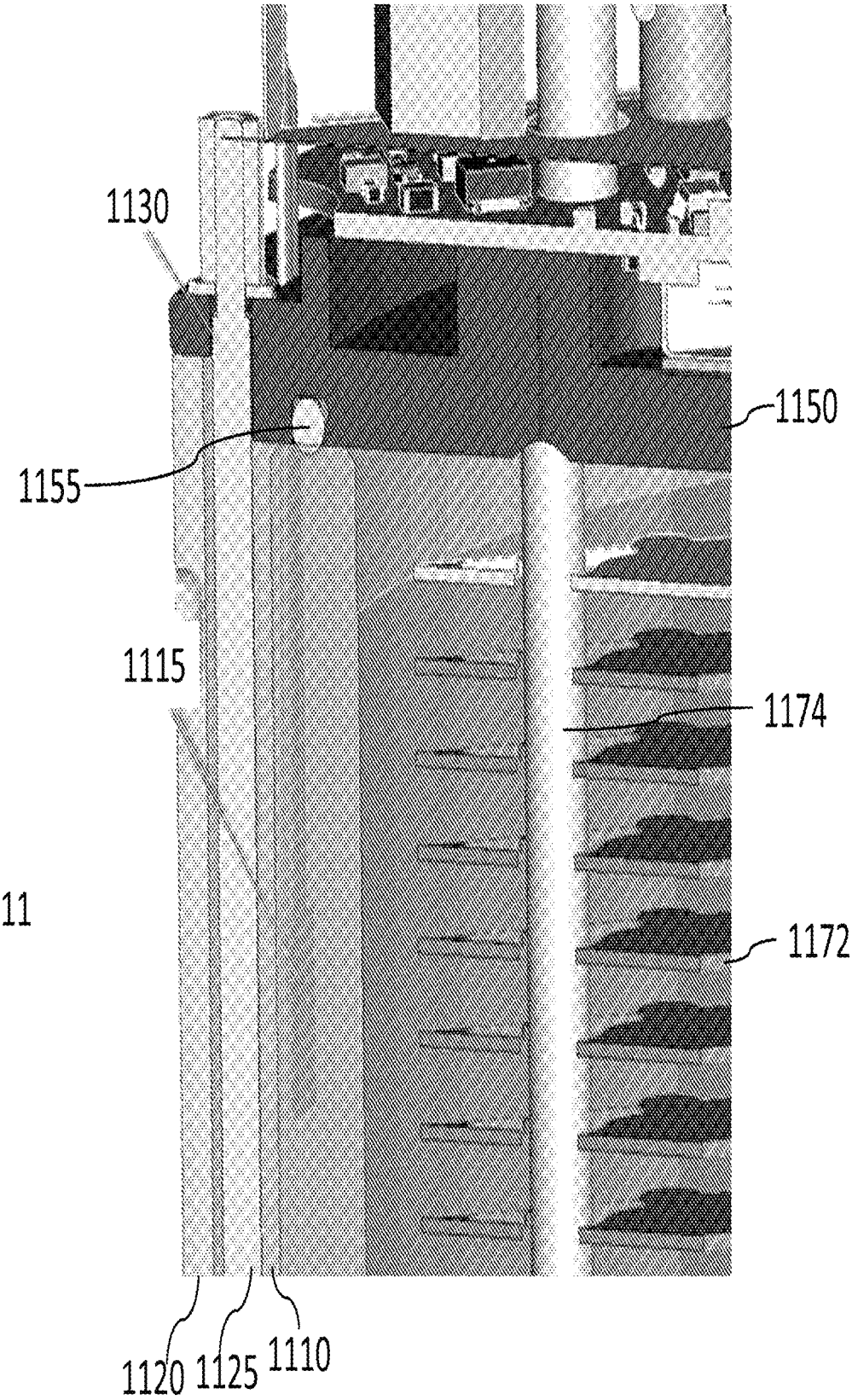
FIG. 11 is an illustration of a resistance temperature detector (RTD) that is coupled to the outside of an inner tube of a time of flight tube, in accordance with certain examples.

Referring to FIG. 11, a side view of another portion of a time of flight tube is shown. An RTD (resistant temperature detector) sensor 1115 is shown as being coupled to an outer surface of an inner tube 1110. A longitudinal tension rod 1130 in an air gap 1125 between an outer tube 1120 and the inner tube 1110 is shown. The tension rod 1130 is positioned along the length of the tubes 1110, 1120 and is operative to couple the tube 1110 to the lid 1150 and to the instrument housing. For example, the tension rod 1130 may include nuts that can be tightened down at each end to a desired torque to provide a closed fluid space within the tube 1110. Spring-loaded fasteners or fasteners other than nuts can also be used. This sealing of the tube 1110 permits vacuum operation of the tube 1110 during ion measurements. An O-ring 1155 can assist in effecting vacuum operation of the assembly. A reflectron assembly including lenses, such as lens 1172 and transverse rods, such as transverse rod 1174 is shown as being positioned within the tube 1110.

Example 4

Figure 12:
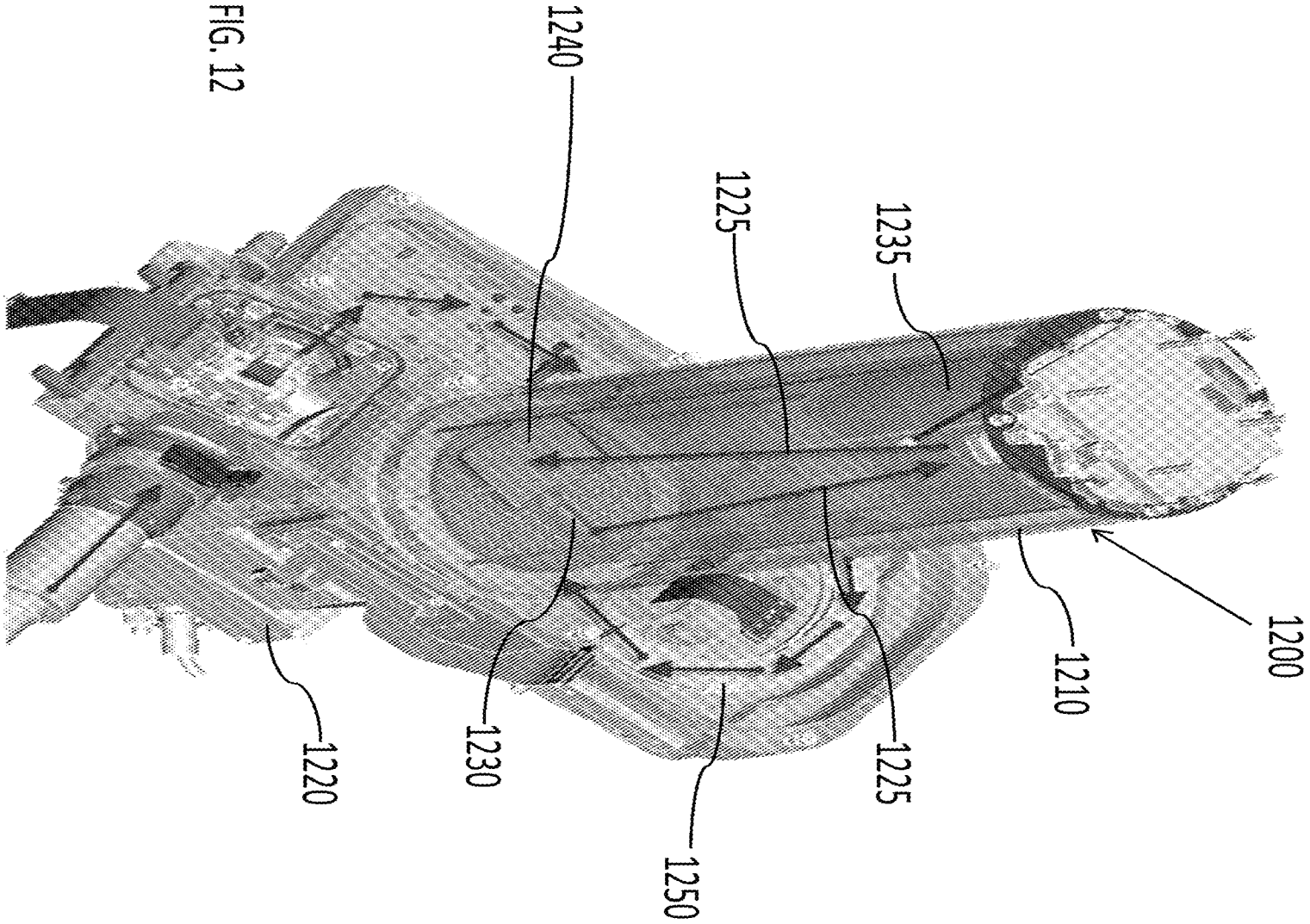
FIG. 12 is a perspective view of a time of flight tube coupled to an instrument housing, in accordance with certain examples.

Referring to FIG. 12, a perspective view of a time of flight tube assembly 1200 coupled to an instrument housing 1220 that includes a cell 1250, e.g., a collision cell, is shown. An ion path 1225 within the tube 1210 is shown. Ions are received from the cell 1250 and released from a pulser 1230 into the tube 1210. It enters a reflectron assembly 1235 where it is reflected back to a detector 1240 for detection.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A time of flight tube assembly comprising:

an inner tube comprising an effective thickness and sized and arranged to couple to and support a reflectron assembly inside the inner tube, the inner tube comprising a conductive material disposed on an inner surface of the inner tube, the conductive material present in an effective amount to provide a field free region for ions when the conductive material is charged;

an outer tube surrounding the inner tube, the outer tube effective to insulate the inner tube and electrically isolate the inner tube;

an air gap between the inner tube and the outer tube, wherein the outer tube is coupled to the inner tube through blocks to permit removal of the outer tube and inner tube together as a unit; and a reflectron assembly coupled to the inner tube, the reflectron assembly comprising a lens stack.

2. The time of flight tube assembly of claim 1, in which the inner tube comprises a material with a coefficient of thermal expansion that is effective to maintain a substantially constant height of the inner tube during operation of the time of flight tube.

3. The time of flight tube assembly of claim 2, in which the coefficient of thermal expansion of the material is effective to permit longitudinal expansion of the inner tube by about two microns or less.

4. The time of flight tube assembly of claim 1, in which the conductive material on the inner surface of the inner tube comprises a coated conductive material.

5. The time of flight tube assembly of claim 1, in which the outer surface of the inner tube is non-conductive.

6. The time of flight tube assembly of claim 1, further comprising a cap coupled to the inner tube.

7. The time of flight tube assembly of claim 6, in which the cap is effective to seal the inner tube to permit vacuum operation of the time of flight tube.

8. The time of flight tube assembly of claim 7, in which the cap is configured to receive a gasket to seal the cap to the inner tube.

9. The time of flight tube assembly of claim 1, further comprising a conductive element electrically coupled to the conductive material disposed on the inner surface of the inner tube.

10. The time of flight tube assembly of claim 9, further comprising a second conductive element disposed on the inner surface of the inner tube, in which the second conductive element is electrically coupled to the first conductive element.

11. The time of flight tube assembly of claim 10, further comprising a contact assembly configured to contact the first conductive element to electrically couple the first conductive element to a power source.

12. The time of flight tube assembly of claim 1, further comprising at least one heater coupled to an outer surface of the inner tube.

13. The time of flight tube assembly of claim 12, further comprising a temperature sensor coupled to the outer surface of the inner tube.

14. The time of flight tube assembly of claim 13, in which the inner tube comprises a material with a coefficient of thermal expansion that is effective to maintain a substantially constant height of the inner tube during operation of the time of flight tube at a temperature provided by the at least one heater.

15. The time of flight tube assembly of claim 14, in which the coefficient of thermal expansion of the material is effective to permit longitudinal expansion of the inner tube by about two microns or less at the temperature provided by the at least one heater.

16. The time of flight tube assembly of claim 1, further comprising a plurality of longitudinal rods coupled to the inner tube.

17. A time of flight tube assembly comprising:

an inner tube comprising an effective thickness and sized and arranged to couple to and support a reflectron assembly inside the inner tube, the inner tube comprising a conductive material disposed on an inner surface of the inner tube, the conductive material present in an effective amount to provide a field free region for ions when the conductive material is charged;

an outer tube surrounding the inner tube, the outer tube effective to insulate the inner tube and electrically isolate the inner tube;

an air gap between the inner tube and the outer tube; and a reflectron assembly coupled to the inner tube, the reflectron assembly comprising a lens stack, in which each lens of the lens stack of the reflectron assembly comprises a planar conductive body comprising a first surface and a second surface, the planar body comprising an aperture between a first side and a second side of the first surface of the planar body, the planar body further comprising a plurality of conductors spanning the aperture from the first side to the second side of the first surface of the planar body, each of the plurality of conductors attached to the planar body at the first side and at the second side of the first surface, in which the plurality of conductors are each substantially parallel to each other and are positioned in the same plane.

18. The time of flight tube assembly of claim 17, further comprising a plurality of transverse rods coupled to each lens of the lens stack.

19. A time of flight tube assembly comprising:

an inner tube comprising an effective thickness and sized and arranged to couple to and support a reflectron assembly inside the inner tube, the inner tube comprising a conductive material disposed on an inner surface of the inner tube, the conductive material present in an effective amount to provide a field free region for ions when the conductive material is charged;

an outer tube surrounding the inner tube, the outer tube effective to insulate the inner tube and electrically isolate the inner tube;

an air gap between the inner tube and the outer tube; and a reflectron assembly coupled to the inner tube, the reflectron assembly comprising a lens stack, in which each lens of the lens stack of the reflectron assembly comprises a first planar body comprising a first surface and a second surface, the first planar body comprising an aperture between a first side and a second side of the first surface of the first planar body, the first planar body further comprising a plurality of conductors spanning the aperture from the first side to the second side of the first surface of the first planar body, each of the plurality of conductors attached to the first surface of the first planar body at the first side and at the second side of the first surface, in which the plurality of conductors are each substantially parallel to each other and are positioned in the same plane, in which the first planar body further comprises a conductive element disposed on the first surface of the first planar body and in contact with each of the plurality of conductors to permit current flow from the planar conductive body to the plurality of conductors.

20. The time of flight tube assembly of claim 19, further comprising a plurality of transverse rods coupled to each lens of the lens stack.

* * * * *